US009217595B2

(12) United States Patent
Kim et al.

(10) Patent No.: US 9,217,595 B2
(45) Date of Patent: Dec. 22, 2015

(54) REFRIGERATOR

(71) Applicant: LG ELECTRONICS INC., Seoul (KR)

(72) Inventors: Yonghyun Kim, Changwon-Si (KR); Ilwook Joung, Changwon-Si (KR); Sungkyoung Kim, Changwon-Si (KR)

(73) Assignee: LG Electronics Inc., Seoul (KR)

( * ) Notice: Subject to any disclaimer, the term of this patent is extended or adjusted under 35 U.S.C. 154(b) by 358 days.

(21) Appl. No.: 13/733,771

(22) Filed: Jan. 3, 2013

(65) Prior Publication Data

US 2013/0167576 A1 Jul. 4, 2013

(30) Foreign Application Priority Data

Jan. 3, 2012 (KR) ..... 10-2012-0000590

(51) Int. Cl.

| | |
|---|---|
| ***F25D 3/02*** | (2006.01) |
| ***F25C 1/00*** | (2006.01) |
| ***F25D 17/06*** | (2006.01) |
| ***F25C 5/18*** | (2006.01) |

(52) U.S. Cl.

CPC . *F25C 1/00* (2013.01); *F25C 5/182* (2013.01); *F25D 17/062* (2013.01); *F25C 2400/10* (2013.01); *F25D 2317/061* (2013.01); *F25D 2317/062* (2013.01); *F25D 2317/063* (2013.01)

(58) Field of Classification Search

CPC ..... F25C 1/00; F25C 5/182; F25C 2400/10; F25D 17/062; F25D 2317/062; F25D 2317/061; F25D 2317/063

USPC ..... 62/74, 340, 344, 407, 420

See application file for complete search history.

(56) References Cited

U.S. PATENT DOCUMENTS

| | | | | |
|---|---|---|---|---|
| 3,280,583 | A * | 10/1966 | Jones et al. | 62/285 |
| 2005/0183441 | A1 | 8/2005 | Lee et al. | |
| 2008/0236187 | A1* | 10/2008 | Kim | 62/344 |
| 2008/0295539 | A1* | 12/2008 | An et al. | 62/407 |
| 2010/0251743 | A1 | 10/2010 | Lee et al. | |
| 2011/0167862 | A1 | 7/2011 | Shin et al. | |
| 2011/0296864 | A1* | 12/2011 | Kim et al. | 62/344 |
| 2014/0083128 | A1 | 3/2014 | Kim et al. | |

FOREIGN PATENT DOCUMENTS

| | | | |
|---|---|---|---|
| CN | 1782639 | A | 6/2006 |
| CN | 1316214 | C | 5/2007 |
| CN | 102121782 | A | 7/2011 |
| CN | 102155838 | A | 8/2011 |

* cited by examiner

*Primary Examiner* — Emmanuel Duke

(74) *Attorney, Agent, or Firm* — Birch, Birch, Kolasch & Birch, LLP

(57) ABSTRACT

A refrigerator is provided. The refrigerator has a refrigerator body including a storage chamber to store foods, a door configured to open or close the storage chamber, an ice maker mounted on the door and an ice maker cover to at least partially cover the ice maker, the ice maker cover including a cool air inlet port for introducing cool air at an upper portion thereof. The ice maker includes a first guide coupled to a lower portion of the ice maker to guide cool air to pass through the lower portion of the ice maker and a second guide provided at an upper side of the ice maker to guide cool air introduced through the cool air inlet port to be branched off and flowed into the upper and lower portions of the ice maker.

19 Claims, 5 Drawing Sheets

REFRIGERATOR

CROSS-REFERENCE TO RELATED APPLICATIONS

The present disclosure relates to subject matter contained in priority Korean Application No. 10-2012-0000590, filed on Jan. 3, 2012, which is herein expressly incorporated by reference in its entirety.

BACKGROUND OF THE INVENTION

1. Field of the Invention

The present disclosure relates to a refrigerator, and more particularly, to a refrigerator for enhancing the ice making capability of an ice maker.

2. Description of Related Art

As is generally known, a refrigerator is a device for storing foods accommodated therein in a freezing or refrigerating state. The refrigerator may include a refrigerator body having a cooling chamber thereinside and a refrigerating cycle apparatus for providing cool air to the cooling chamber.

FIG. 1 is a perspective view illustrating a refrigerator in the related art, and FIG. 2 is a cross-sectional view illustrating an ice maker area in FIG. 1. As illustrated in FIGS. 1 and 2, a refrigerator may include a refrigerator body 10 having a cooling chamber 20 and a refrigerating cycle apparatus (not shown) for providing cool air to the cooling chamber 20. The cooling chamber 20 may be provided within the refrigerator body 10. The cooling chamber 20 may include a freezing chamber 21 and a refrigerating chamber 22.

A door 30 for opening or closing the cooling chamber 20 may be provided at a front surface of the refrigerator body 10. The door 30 may include a freezing chamber door 31 and a refrigerating chamber door 32 for opening or closing the freezing chamber 21 and refrigerating chamber 22, respectively.

An ice making chamber 40 may be formed in the freezing chamber 21, for example, in the freezing chamber door 31. The ice making chamber 40 may be formed in an upper area of the freezing chamber door 31. A cool air inlet port for introducing cool air to the inside may be formed in an upper area of the ice making chamber 40.

An ice maker 41 may be provided within the ice making chamber 40, as illustrated in FIG. 2. An ice bank 60 in which pieces of ice (ice cubes) made by and dropped from the ice maker 41 are stored therein. The ice bank 60 may be provided at a lower side of the ice maker 41.

The ice maker 41 may include an ice-making tray 45 for forming predetermined shaped ice cubes thereinside, and an ejector 47 for ejecting ice cubes formed within the ice-making tray 45, for example. A side wall portion 48 may be provided at one side of the ice-making tray 45. The ice maker 41 may be disposed to be separated from the freezing chamber door 31 by a predetermined distance. Due to this, a cool air passage 65 through which cool air moves downward may be formed between the side wall portion 48 and the freezing chamber door 31.

However, according to a refrigerator in the related art, water accommodated within the ice-making tray 45 may be cooled down to make ice while cool air introduced through the cool air inlet port formed in an upper area of the ice making chamber 40 moves downward, thereby causing a delay in making ice. Furthermore, cool air moved downward through the ice maker 41 may be directly brought into contact with pieces of ice accommodated within the ice bank 60, thereby causing pieces of ice to be adhered to one another.

BRIEF SUMMARY OF THE INVENTION

The present disclosure is provided to solve the foregoing problem, and an object of the present disclosure is to provide a refrigerator capable of enhancing the ice making capability of an ice maker.

Furthermore, another object of the present disclosure is to provide a refrigerator capable of suppressing ice cubes made by the ice maker and accommodated in a storage space from being adhered to one another.

In order to accomplish the foregoing objectives of the present disclosure, there is provided a refrigerator having a refrigerator body including a storage chamber to store foods, a door configured to open or close the storage chamber, an ice maker mounted on the door and an ice maker cover to at least partially cover the ice maker, the ice maker cover including a cool air inlet port for introducing cool air at an upper portion thereof. The ice maker includes a first guide coupled to a lower portion of the ice maker to guide cool air to pass through the lower portion of the ice maker and a second guide provided at an upper side of the ice maker to guide cool air introduced through the cool air inlet port to be branched off and flowed into the upper and lower portions of the ice maker.

In addition, an ice making apparatus for a refrigerator is also provided. The ice making apparatus includes an ice maker configured to be mounted to a door of the refrigerator and an ice maker cover to at least partially cover the ice maker, the ice maker cover including a cool air inlet port for introducing cool air at an upper portion thereof. The ice maker includes a first guide coupled to a lower portion of the ice maker to guide cool air to pass through the lower portion of the ice maker and a second guide provided at an upper side of the ice maker to guide cool air introduced through the cool air inlet port to be branched off and flowed into the upper and lower portions of the ice maker.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE INVENTION

Hereinafter, an exemplary embodiment of the present disclosure will be described in detail with reference to the accompanying drawings.

Figure 1:
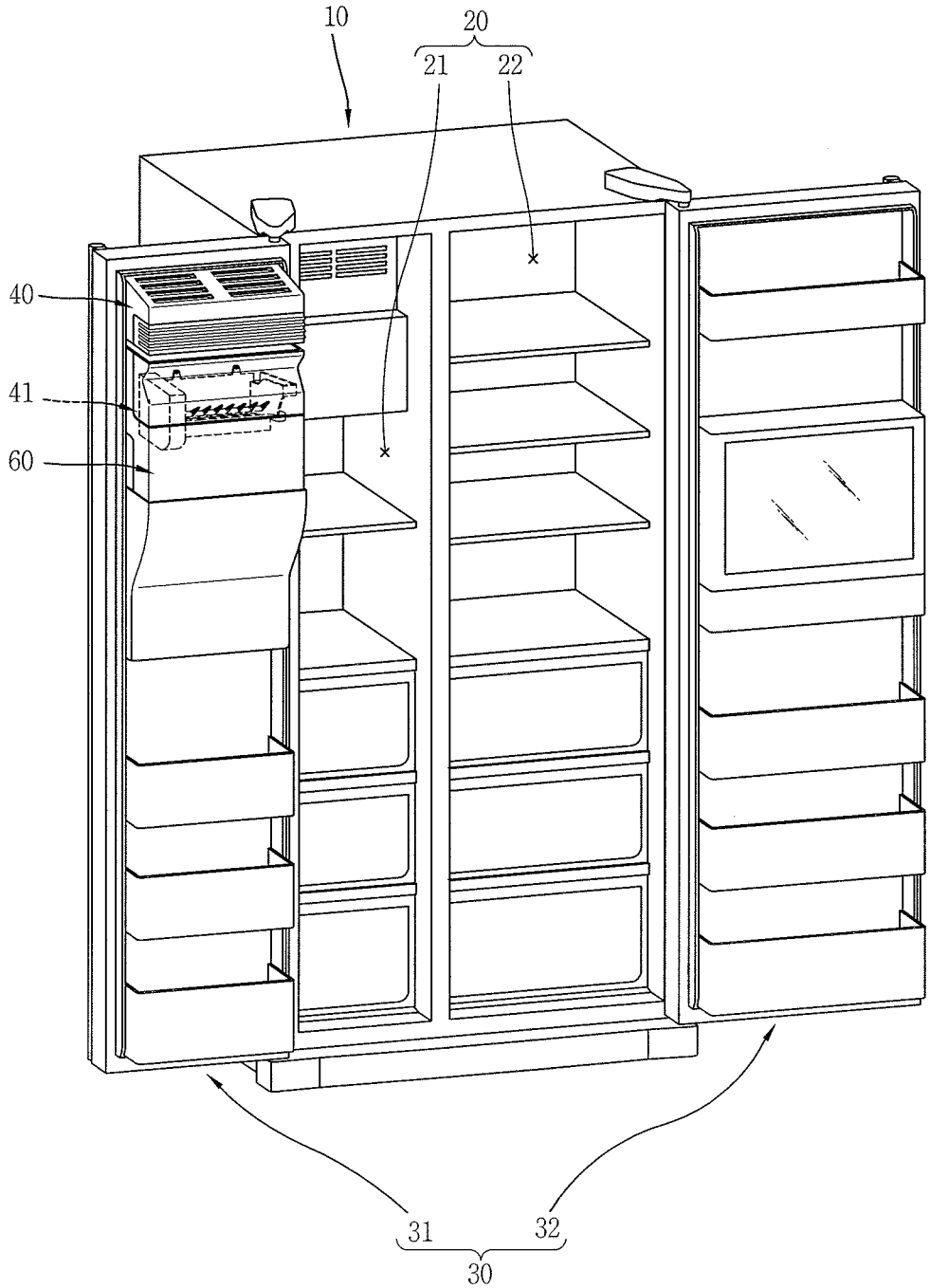
FIG. 1 RELATED ART
FIG. 1 is a perspective view illustrating a refrigerator in the related art.
Figure 2:
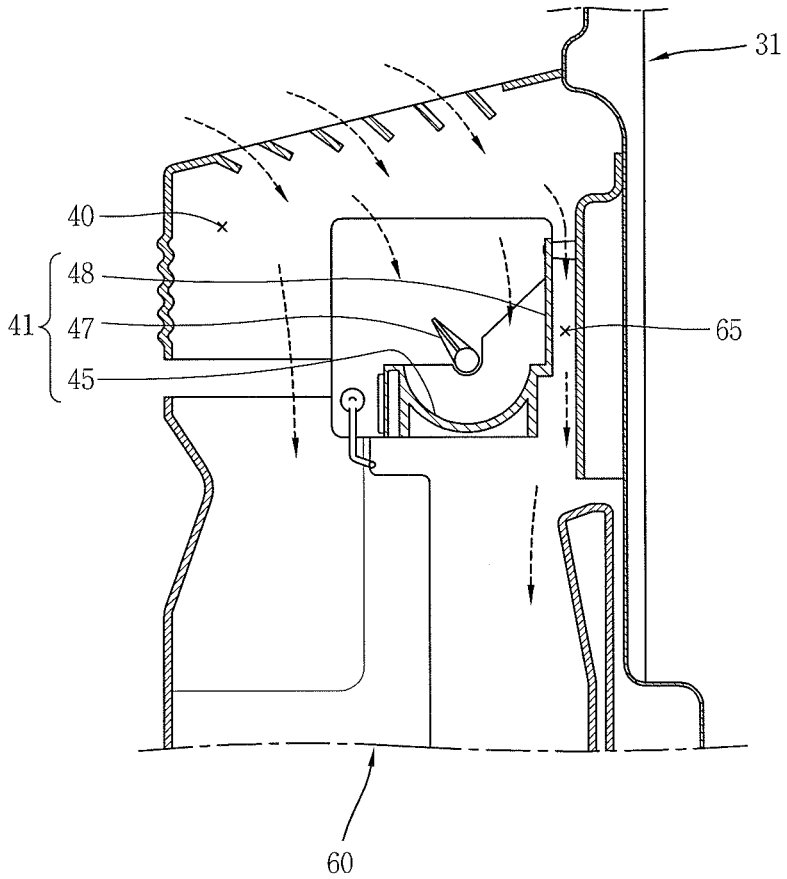
FIG. 2 RELATED ART
FIG. 2 is a cross-sectional view illustrating an ice maker region in FIG. 1.
Figure 3:
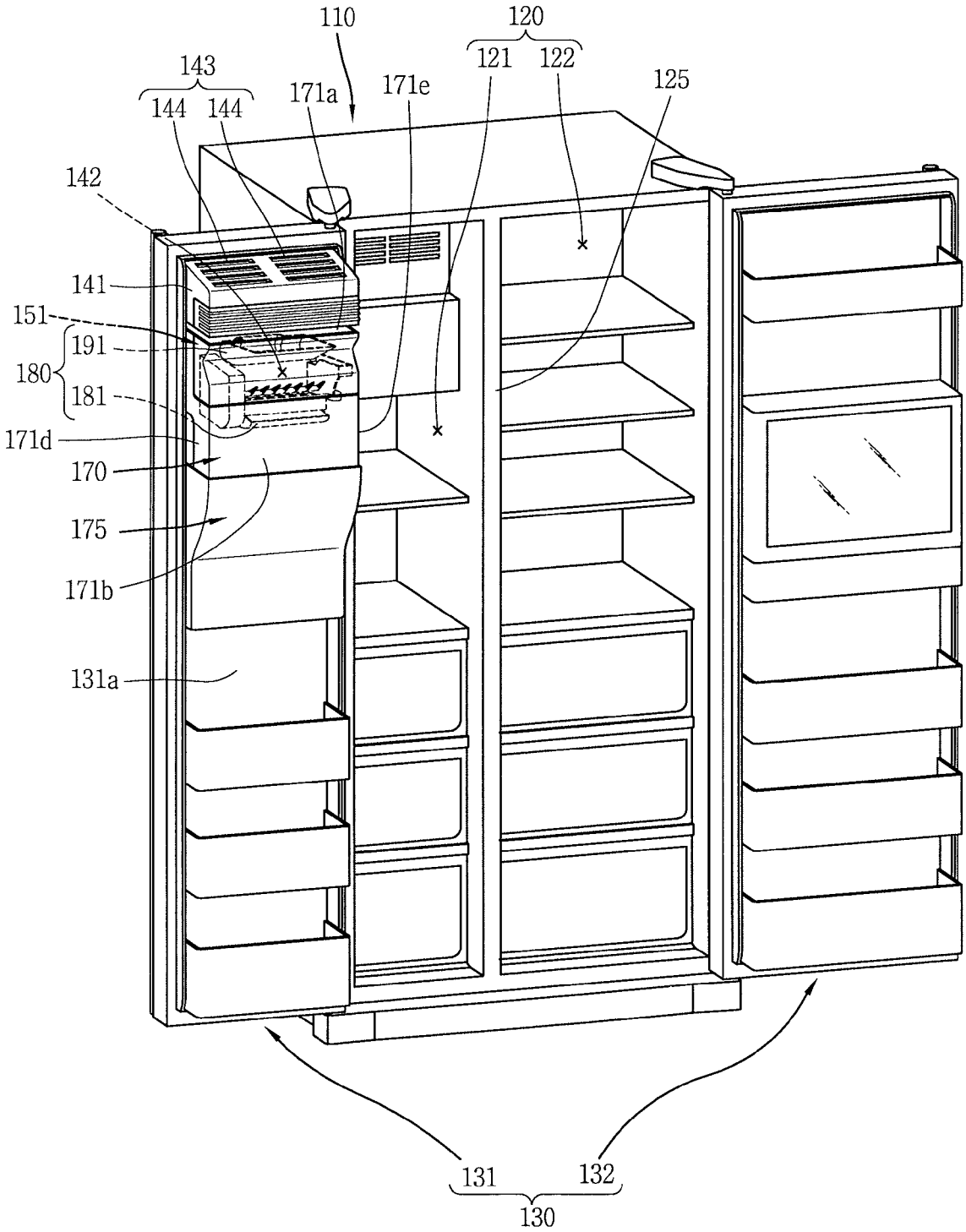
FIG. 3 is a perspective view illustrating a refrigerator according to an embodiment of the present disclosure.

As illustrated in FIG. 3, a refrigerator according to an embodiment of the present disclosure may include a refrigerator body 110 having an ice making chamber 142 thereinside, an ice maker 151 disposed within the ice making chamber 142, and a cool air guide 180 configured to guide cool air to the surroundings of the ice maker 151. A cooling chamber 120 may be provided within the refrigerator body 110 and a door 130 for opening or closing the cooling chamber 120 may be provided at the refrigerator body 110.

A plurality of cooling chambers 120 may be provided therein. For example, the cooling chamber 120 may include a freezing chamber 121 and a refrigerating chamber 122. Alternatively, the refrigerator body 110 may be also configured to have either one of the freezing chamber 121 and the refrigerating chamber 122.

The cooling chamber 120 may be fanned to be partitioned into left and right sides by interposing a partition wall 125 disposed in the top-down (vertical) direction. Alternatively, the cooling chamber 120 may be formed to be partitioned into top and bottom sides by interposing a partition wall (not shown) disposed in the left-right (horizontal) direction. Hereinafter, a case in which the cooling chamber 120 is formed to be partitioned into left and right sides by interposing a partition wall 125 disposed in the top-down direction will be described as an example.

The door 130 may include a freezing chamber door 131 for opening or closing the freezing chamber 121 and a refrigerating chamber door 132 for opening or closing the refrigerating chamber door 132.

An ice making chamber 142 may be provided in the refrigerator body 110, for example, in the ice making chamber 142. According to the present embodiment, the ice making chamber 142 is formed in the freezing chamber door 131; however it is understood that the ice making chamber 142 may be formed within the freezing chamber 121. Furthermore, the ice making chamber may be formed in a refrigerating chamber door in a so-called bottom freezer refrigerator, for example.

Figure 4:
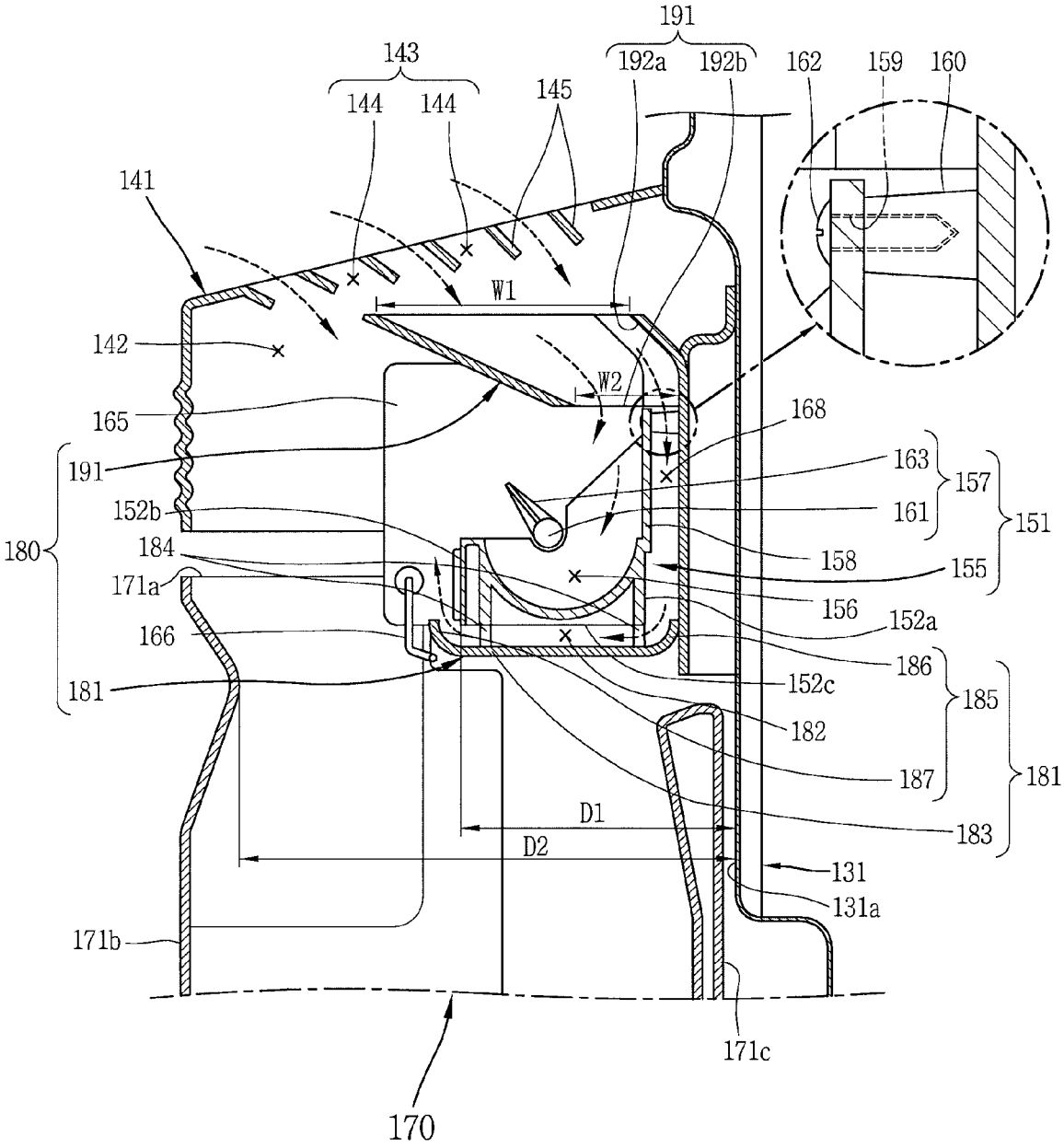
FIG. 4 is a cross-sectional view illustrating an ice maker region in FIG. 3.

An ice making chamber cover 141 at least partially defining the ice making chamber 142 thereinside may be provided in the freezing chamber door 131 as illustrated in FIG. 4. A cool air inlet port 143 for introducing cool air to the ice making chamber 142 may be formed on the ice making chamber cover 141, for example, at an upper surface of the ice making chamber cover 141. An upper surface of the ice making chamber cover 141 may be formed to be inclined downward along the protrusion direction. The cool air inlet port 143 may include a plurality of through holes 144 formed to penetrate the ice making chamber cover 141 where each through hole 144 may be formed to have a long length in one direction thereof. The ice making chamber cover 141 is formed with an insulating material.

A guide member 145 (see FIG. 4) for guiding the flow of cool air may be provided in the cool air inlet port 143. The guide member 145 may be configured to guide cool air introduced through the cool air inlet port 143 to an upper one side of the ice maker 151, for example. Because of this arrangement, the concentration cooling of the ice maker 151 may be effectively carried out.

A plurality of guide members 145 may be provided in the cool air inlet port 143. More specifically, a guide member 145 may be provided at one side of each through hole 144.

In the exemplary embodiment, the ice maker 151 may be provided in the ice making chamber 142. An ice bank 170 in which pieces of ice made by the ice maker 151 are stored may be provided at a lower side of the ice maker 151. The ice bank 170 may include a top opening 171*a*, a front wall 171*b*, side walls 171*d*, 171*e*, and a rear wall 171*c* adjacent to the inner wall 131*a* of the door 131. The ice bank 170 may be configured to discharge ice cubes as they are formed or discharge ice cubes crushed into small pieces. An ice dispenser 175 for providing ice provided from the ice bank 170 to the outside may be provided at a lower side of the ice bank 170, as illustrated in FIG. 3.

The ice maker 151 may include an ice making tray 155 in which water is accommodated to form a predetermined shaped piece of ice and an ejector 157 for ejecting pieces of ice made by the ice making tray 155, as illustrated in FIG. 4. The ice making tray 155 may include a rear side portion 152*a* provided separate from the inner wall 131*a* of the door 131 such that a cool air passage is formed between the rear side portion 152*a* and the inner wall 131*a* of the door 131, a front side portion 152*b* opposite to the rear side portion 152*a*, and a bottom portion 152*c* disposed between the rear side portion 152*a* and the front side portion 152*b*.

The ice making tray 155 may include a plurality of cells 156 partitioned to form predetermined shaped pieces of ice (ice cubes) in a separable manner. The cells may be disposed to be separated from one another by interposing a partition wall (separating wall) along the axial direction For example, the ice making tray 155 may be configured to have a rectangular shape having a long length in one direction. In addition, the ice making tray 155 may be configured such that its lateral cross section has a semi-circular shape. As a result, semi-circular shaped pieces of ice (ice cubes) may be formed.

The ice making tray 155 may be disposed to be separated from an inner surface (inner wall) of the freezing chamber door 131 by a predetermined distance. As a result, an upper cool air passage 168 for moving cool air in the downward direction may be formed between the ice making tray 155 and an inner surface of the freezing chamber door 131.

The ejector 157 may include a rotating shaft 161 rotatably disposed at an upper side of the ice making tray 155 and a plurality of ejector pins 163 protruded in the radial direction on the rotating shaft 161 to correspond to the each cell 156. The ejector pins 163 may be rotated along an inner portion of the each cell 156 to press ice formed at an inner portion of the relevant cell 156, thereby releasing ice from the relevant cell 156.

An upward extended side wall 158 may be provided at one lateral long edge portion of the ice making tray 155. A coupling portion 159 for fixing or coupling the ice making tray 155 thereto may be formed at the side wall 158, for example. The coupling portion 159 may be formed to penetrate the side wall 158. For example, a fastening member 162 may be inserted into the coupling portion 159 and a boss portion 160, to which the fastening member 162 is coupled, may be provided at a rear side of the coupling portion 159. The fastening member 162 may be formed with a screw to be screw-coupled to the boss portion 160.

An ice releasing heater (not shown) for heating the ice making tray 155 to release ice formed in an inner portion of the ice making tray 155 from the ice making tray 155 may be provided at an outer surface of the ice making tray 155.

A controller 165 for driving and/or controlling the ejector 157 and ice releasing heater may be provided at one side of the ice making tray 155. An ice full sensing lever or ice detecting unit 166 for sensing whether or not ice cubes are full may be provided at one side of the controller 165.

Figure 5:
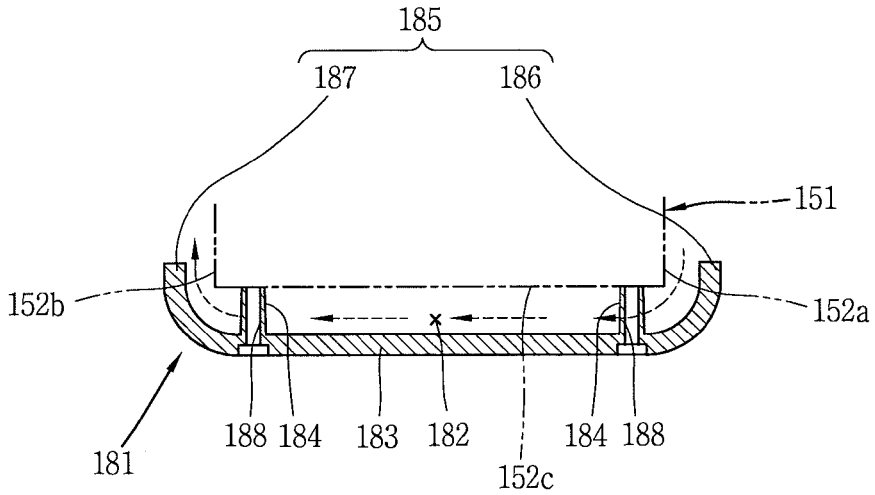
FIG. 5 is an enlarged view illustrating a first guide in FIG. 4.

A cool air guide 180 for guiding cool air to the surroundings of the ice maker 151 may be provided at one side of the ice maker 151. By providing the cool air guide 180, the cooling speed of the ice maker 151 may be increased to reduce the ice making time. The cool air guide 180 may include a first guide 181 disposed at a lower side of the ice maker 151, for example. The first guide 181 may be configured to form a lower cool air passage 182 between a bottom surface of the ice maker 151 and the first guide 181 as illustrated in FIG. 5. Due to this, cool air cools down a bottom surface of the ice maker 151 (ice making tray 155) while moving along the lower cool air passage 182, thereby further reducing the ice making time.

More specifically, contrary to the related art in which cool air simply moves downward along the upper cool air passage 168 between the side wall 158 and an inner surface of the freezing chamber door 131, the first guide 181 guides the cool air moving downward along the upper cool air passage 168 to be brought into contact with a bottom surface of the ice making tray 155, and thus the cool air may be directly brought into contact with the ice making tray 155, thereby greatly reducing the ice making time.

The first guide 181 may include a body 183 disposed to be separated from a lower side of the ice maker 151 and a lateral guide portion 185 disposed in parallel with a long edge portion of the ice maker 151 from one side of the body 183. The body 183 may be formed in a substantially rectangular plate shape to correspond to a plane projection shape of the ice making tray 155, for example. The body 183 may be formed to be enlarged in the width direction of the ice making tray 155. Accordingly, cool air moving downward may pass through the lower side to surround an outer surface of the ice making tray 155 with a predetermined width around the ice making tray 155.

The body 183 may be provided with a spacer 184 protruded upward from an inner surface thereof. The spacer 184 may be brought into contact with a bottom portion of the ice making tray 155. Due to this, the ice making tray 155 is separated from the body 183 by a predetermined distance and the lower cool air passage 182 may be formed therebetween. Here, a fastening hole 188 may be foamed to penetrate a shaft center thereof. A fastening member (not shown), a front end portion of which is coupled to the ice making tray 155, may be inserted and coupled to the fastening hole 188. In this manner, the first guide 181 may be incorporated and coupled to a bottom portion of the ice making tray 155 in a detachable manner.

A plurality of lateral guide portions 185 may be provided therein. More specifically, the lateral guide portion 185 may include an upstream lateral guide portion 186 provided at an upstream side thereof along the movement direction of cool air moving downward along the upper cool air passage 168 and a downstream lateral guide portion 187 provided at a downstream side thereof.

The upstream lateral guide portion 186 may extend upward to correspond to a long edge portion of the ice maker 151 from the body 183. More specifically, the upstream lateral guide portion 186 may extend upward while being separated from an upstream long edge portion of the body 183 by a predetermined distance. As a result, cool air moving downward around the ice making tray 155 may be guided to the lower cool air passage 182 formed between the ice making tray 155 and body 183 and it may be possible to enhance the cooling of the ice maker 151 (ice making tray 155).

The upstream lateral guide portion 186 may be brought into contact with an inner wall (inner surface) of the freezing chamber door 131 such that a lower region of the upper cool air passage 168 formed between the side wall 158 and an inner wall of the freezing chamber door 131 may be blocked by the upstream lateral guide portion 186 to guide cool air moving downward to a lower side of the ice making tray 155. Accordingly, cool air moving downward to the side of the ice bank 170 along the upper cool air passage 168 may be suppressed, thereby preventing ice within the ice bank 170 from being adhered to one another.

The downstream lateral guide portion 187 may extend upward to correspond to a long edge portion of the ice maker 151 from the body 183. More specifically, the downstream lateral guide portion 187 may extend upward while being separated from a downstream long edge portion of the body 183 such that cool air moving through a lower side of the ice maker 151 may be guided to move upward to a long edge portion side of the ice maker 151. Accordingly, cool air moving along the lower cool air passage 182 may move upward along the other long edge portion of the ice making tray 155 to enhance the cooling of the other long edge portion of the ice making tray 155. In other words, according to the foregoing configuration, cool air moving downward along one side (long edge portion) of the ice maker 151 passes through a lower side (lower cool air passage 182) of the ice maker 151 and moves upward along the other side (long edge portion) of the ice maker 151 to cool down the upper surface, both lateral surfaces (both lateral long edge portions), and bottom surface thereof. As a result, it may be possible to greatly reduce the ice making time of the ice maker 151.

A second guide 191 for guiding cool air to one upper region of the ice maker 151 may be provided at an upper side of the ice maker 151. The second guide 191 may be configured to guide cool air to an upper surface and one lateral surface of the ice maker 151 such that cool air merely being introduced into an inner upper region of the ice making chamber 142 through the upper cool air inlet port 143 of the ice making chamber 142 may be guided to an upper surface and one lateral surface of the ice maker 151, thereby intensively cooling down the ice maker 151. Accordingly, it may be possible to further reduce the ice making time of the ice maker 151. Moreover, cool air may be supplied to one lateral long edge portion of the ice maker 151 while passing through the bottom portion and sequentially moving to the other long edge portion to cool down the ice maker 151, and thus the exhaust of bubbles contained in water may be effectively carried out, thereby obtaining transparent ice.

Figure 6:
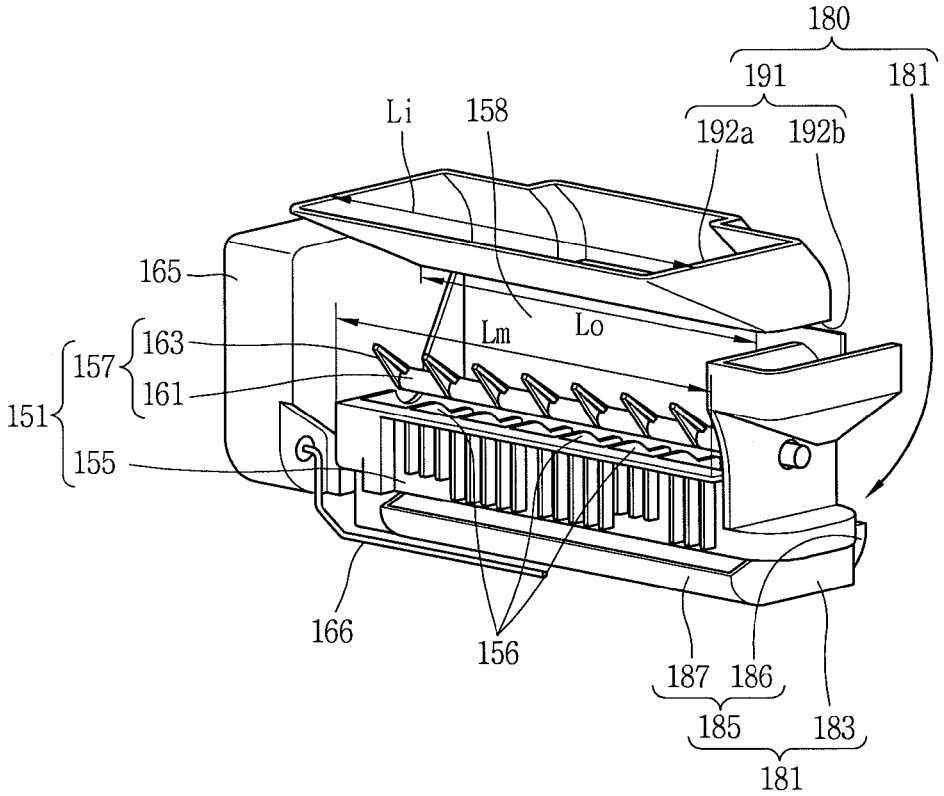
FIG. 6 is a view illustrating a configuration in which an ice maker and a cool air guide in FIG. 3 are disposed.

The second guide 191 may be provided to be separated from the ice maker 151 by a predetermined distance. The second guide 191 may be configured to form a cool air passage thereinside, for example. More specifically, the second guide 191 may be formed with a tubular shaped body provided with a cool air inlet portion 192*a* for introducing cool air at an upper side thereof, and a cool air outlet portion 192*b* for exhausting cool air at a lower side thereof as illustrated in FIG. 6.

The second guide 191 may be configured to have a rectangular ring shaped cross section and/or be configured to reduce the flow area of the cool air located close to the lower side thereof. More specifically, the second guide 191 may be configured such that an inner width W1 of the cool air inlet portion 192*a* is relatively large and an inner width W2 of the cool air outlet portion 192*b* is relatively small. According to the foregoing configuration, a lot of cool air may be collected from the upper side to provide cool air to the upper surface and one lateral surface of the ice maker 151, which may make it possible to further enhance the cooling of the ice maker 151.

According to the present embodiment, the length of the second guide 191 may be configured to correspond to and/or be the same as the length of the ice making tray 155 of the ice maker 151. Alternatively, the second guide 191 may be configured such that the length Li of the cool air inlet portion 192*a* is formed to be greater than the length Lm of the ice making tray 155 of the ice maker 151 and the length Lo of the cool air outlet portion 192*b* at a lower side thereof may be the same or similar to that of the ice making tray 155. According to the foregoing configuration, the ice maker 151 may be disposed to be separated from an inner portion of the ice making chamber 142 to form a cool air passage between an inner wall of the freezing chamber door 131 and the inner portion of the ice making chamber 142.

As noted above, the first guide 181 may be provided at a lower side of the ice maker 151 and the second guide 191 may be provided at an upper side of the ice maker 151. The first guide 181 may be coupled to a bottom portion of the ice making tray 155 of the ice maker 151 and the second guide 191 may guide cool air at the upper side beyond an upper surface of the ice maker 151 and/or the side wall 158.

On the other hand, cool air may be introduced through the cool air inlet port 143 at an inner portion of the ice making chamber 142. The cool air introduced through the cool air inlet port 143 may be guided beyond an upper surface of the ice maker 151 and/or the side wall 158 by the second guide 191. Part of the cool air guided by an upper surface of the ice maker 151, namely, the second guide 191, may be guided to an upper surface of the ice making tray 155 to directly cool down water that has been supplied to the ice making tray 155 and part of the cool air guided by the second guide 191 may be introduced into the upper cool air passage 168 formed beyond the side wall 158.

The cool air introduced into the upper cool air passage 168 may move downward, and move along one lateral portion (right side portion in the drawing) and a bottom surface portion of the ice making tray 155 by the first guide 181 at the lower portion. As a result, one lateral portion and a bottom surface portion of the ice making tray 155 may be cooled down by the cool air flowing along the one lateral portion and bottom surface portion of the ice making tray 155. The cool air guided to the other lateral portion (left side portion in the drawing) of the ice making tray 155 by the first guide 181 may move upward while surrounding the other lateral portion of the ice making tray 155 by the lateral guide portion 185. Due to this, the other lateral portion of the ice making tray 155 may be cooled down.

In addition, the cool air introduced into the ice making chamber 142 may be guided by the second guide 191 and first guide 181 and brought into contact with the upper surface, both lateral surfaces, and bottom surface of the ice making tray 155 to directly cool down all four sides of the ice making tray 155, thereby greatly reducing the ice making time of the ice maker 151.

Furthermore, the first guide 181 may suppress cool air flowing downward along a cool passage between the ice maker 151 and an inner wall surface of the freezing chamber door 131 from moving downward to the ice bank 170, thereby preventing ice (ice cubes) stored within the ice bank 170 from being adhered to one another.

As described above, according to an embodiment of the present disclosure, a cool air guide for guiding cool air to the surroundings of the ice maker may be provided around the ice maker, and the cool air guide may be provided with a first guide for guiding cool air to pass through a lower side of the ice maker, thereby reducing the ice making time of the ice maker. Due to this, it may be possible to enhance the ice making capability of the ice maker per unit time.

Furthermore, the cool air guide may be provided with a second guide for guiding cool air to an upper surface and one lateral surface of the ice maker, thereby further reducing the ice making time of the ice maker.

Furthermore, the first guide may be configured to have a lateral guide portion corresponding to both long edge portions of the ice making tray, and thus cool air moving downward along one side of the ice making tray may be guided to move along both lateral surfaces and a bottom surface of the ice making tray, thereby enhancing the cooling of the ice making tray.

Furthermore, the first guide may be disposed to block a lower region of the cool air passage formed between a side wall of the ice making tray and an inner wall of the door, and thus cool air moving downward along the cool air passage may be guided to pass through a lower side of the ice making tray without moving toward the ice bank. Due to this, it may be possible to enhance the cooling of the ice making tray as well as preventing ice cubes within the ice bank from being adhered to one another.

As described above, specific embodiments of the present invention are illustrated and described herein with reference to the accompanying drawings. However, the present invention can be implemented in various embodiments without departing from the concept or gist of the invention, and thus the foregoing embodiments should not be limited to the content of the detailed description.

Furthermore, the foregoing embodiments should be broadly construed within the scope of the technical concept defined by the appended claims even though they are not specifically disclosed in the detailed description herein. Moreover, all changes and modifications within the technical scope of the claims and the equivalent scope thereof should be construed to be included in the appended claims.

What is claimed is:

1. A refrigerator comprising:

a refrigerator body including a storage chamber to store foods;

a door configured to open or close the storage chamber;

an ice maker mounted on the door; and an ice maker cover to at least partially cover the ice maker, the ice maker cover including a cool air inlet port for introducing cool air at an upper portion thereof and a plurality of guide members inclinedly disposed at the cool air inlet port to guide cool air introduced through the cool air inlet port to an inner wall of the door, wherein the ice maker includes:

a first guide coupled to a lower portion of the ice maker to guide cool air to pass the lower portion of the ice maker; and a second guide provided at an upper side of the ice maker to guide the cool air guided by the plurality of guide members to be branched off and flowed into the upper and lower portions of the ice maker, wherein the second guide is formed with a tubular body with a cool air inlet portion for introducing cool air and a cool air outlet portion for exhausting cool air, wherein the second guide is inclinedly disposed to correspond to the plurality of guide members so that the cool air guided by the plurality of guide members is guided to an upper one side of the ice maker, and wherein the second guide is formed such that a flow cross sectional area is reduced along the movement direction of cool air flow.

2. The refrigerator of claim 1, wherein the ice maker includes a side wall that is provided separate from the inner wall of the door such that an upper cool air passage is formed between the side wall and the inner wall.

3. The refrigerator of claim 1, wherein the first guide includes a body provided separate from a lower side of the ice maker to form a lower cool air passage between a bottom surface of the ice maker and the body.

4. The refrigerator of claim 3, wherein the body includes a spacer protruded from an inner surface thereof.

5. The refrigerator of claim 4, wherein a fastening hole is formed at the spacer to penetrate therethrough.

6. The refrigerator of claim 3, wherein the ice maker comprises an ice making tray having a pair of side portions and a bottom portion, each side portion being located at opposite ends of the bottom portion, and the first guide comprises an upward extended lateral guide portion corresponding to one of the side portions of the ice maker, the guide portion being located at the body.

7. The refrigerator of claim 6, wherein the lateral guide portion comprises an upstream lateral guide portion provided at a lower side of the upper cool air passage.

8. The refrigerator of claim 6, wherein the lateral guide portion comprises a downstream lateral guide portion provided at a downstream side of the body along the movement direction of the cool air.

9. The refrigerator of claim 1, wherein the second guide is formed such that an inner width of the cool air outlet portion corresponds to the length of the ice maker, and an inner width of the cool air inlet portion is greater than the inner width of the cool air outlet portion.

10. The refrigerator of claim 1, further comprising an ice bank provided at a lower portion of the ice maker to store ice.

11. An ice making apparatus for a refrigerator, the apparatus comprising:

an ice maker configured to be mounted to a door of the refrigerator; and an ice maker cover to cover the ice maker, the ice maker cover including a cool air inlet port for introducing cool air at an upper portion thereof and a plurality of guide members inclinedly disposed at the cool air inlet port to guide cool air introduced through the cool air inlet port to an inner wall of the door, wherein the ice maker includes:

a first guide coupled to a lower portion of the ice maker to guide cool air to pass the lower portion of the ice maker; and a second guide provided at an upper side of the ice maker to guide the cool air guided by the plurality of guide members to be branched off and flowed into the upper and lower portions of the ice maker, wherein the second guide is formed with a tubular body with a cool air inlet portion for introducing cool air and a cool air outlet portion for exhausting cool air, wherein the second guide is inclinedly disposed to correspond to the plurality of guide members so that the cool air guided by the plurality of guide members is guided to an upper one side of the ice maker, and wherein the second guide is formed such that a flow cross sectional area is reduced along the movement direction of cool air flow.

12. The apparatus of claim 11, wherein the first guide includes a body provided separate from a lower side of the ice maker to form a lower cool air passage between a bottom surface of the ice maker and the body.

13. The apparatus of claim 12, wherein the body includes a spacer protruded from an inner surface thereof.

14. The apparatus of claim 12, wherein the ice maker comprises an ice making tray having a pair of side portions and a bottom portion, each side portion being located at opposite ends of the bottom portion, and the first guide comprises an upward extended lateral guide portion corresponding to one of the side portions of the ice making tray, the guide portion being located at the body.

15. The apparatus of claim 11, further comprising an ice bank provided at a lower portion of the ice maker to store ice.

16. A refrigerator comprising:

a refrigerator body including a storage chamber to store foods;

a door configured to open or close the storage chamber, the door having an inner wall;

an ice maker mounted on the door;

an ice maker cover to at least partially cover the ice maker, the ice maker cover including a cool air inlet port for introducing cool air and a plurality of guide members inclinedly disposed at the cool air inlet port to guide cool air introduced through the cool air inlet port to an inner wall of the door; and an ice bank provided under the ice maker inside the ice maker cover, the ice bank having a top opening, a front wall, at least two side walls and a rear wall adjacent to the inner wall of the door, wherein the ice maker includes:

an ice making tray having a rear side portion provided separate from the inner wall of the door such that a cool air passage is formed between the rear side wall and the inner wall of the door, a front side portion opposite to the rear side portion, and a bottom portion between the rear side portion and the front side portion;

a first guide coupled to a lower portion of the ice maker to be in fluid communication with the cool air passage to introduce cool air into the lower portion of the ice maker; and a second guide provided to guide the cool air guided by the plurality of guide members to be branched off and flowed into an upper portion and the lower portion of the ice maker, and wherein a distance from the front side portion of the ice making tray to the inner wall of the door is smaller than a distance from the front wall of the ice bank to the inner wall of the door, wherein the second guide is formed with a tubular body with a cool air inlet portion for introducing cool air and a cool air outlet portion for exhausting cool air, wherein the second guide is inclinedly disposed to correspond to the plurality of guide members so that the cool air guided by the plurality of guide members is guided to an upper one side of the ice maker, and wherein the second guide is formed such that a flow cross sectional area is reduced along the movement direction of cool air flow.

17. The refrigerator of claim 16, wherein the ice maker cover covers the ice maker and the ice bank.

18. The refrigerator of claim 17, wherein the ice maker cover is formed with an insulating material.

19. The refrigerator of claim 16, wherein the first guide comprises a body and a downstream lateral guide portion extended upward from a downstream side of the body to form an air path from the bottom portion of the ice making tray toward the top opening of the ice bank.

* * * * *